US009115712B2

(12) United States Patent
Liu et al.

(10) Patent No.: US 9,115,712 B2
(45) Date of Patent: Aug. 25, 2015

(54) SWING BARREL TYPE POSITIVE DISPLACEMENT PUMP USING CROSS SHAFT JOINT BEARING

(76) Inventors: Dalei Liu, Guangdong (CN); Wanxiu Shao, Guangdong (CN)

( * ) Notice: Subject to any disclaimer, the term of this patent is extended or adjusted under 35 U.S.C. 154(b) by 316 days.

(21) Appl. No.: 13/877,908

(22) PCT Filed: Mar. 16, 2011

(86) PCT No.: PCT/CN2011/071862

§ 371 (c)(1), (2), (4) Date: Apr. 5, 2013

(87) PCT Pub. No.: WO2012/058893

PCT Pub. Date: May 10, 2012

(65) Prior Publication Data

US 2013/0195691 A1 Aug. 1, 2013

(30) Foreign Application Priority Data

Nov. 3, 2010 (CN) ..... 2010 1 0529892

(51) Int. Cl.

| | |
|---|---|
| ***F04B 1/16*** | (2006.01) |
| ***F04B 53/00*** | (2006.01) |
| ***F04B 9/04*** | (2006.01) |
| ***F04B 9/02*** | (2006.01) |

(52) U.S. Cl.

CPC . *F04B 53/00* (2013.01); *F04B 1/16* (2013.01); *F04B 9/02* (2013.01); *F04B 9/04* (2013.01)

(58) Field of Classification Search

CPC ..... F16C 35/04; F04B 53/00; F04B 1/16; F04B 9/04; F04B 9/02

See application file for complete search history.

(56) References Cited

U.S. PATENT DOCUMENTS

| | | | | |
|---|---|---|---|---|
| 4,487,108 | A | 12/1984 | McLuen | |
| 6,334,512 | B1 * | 1/2002 | Forster | 188/71.5 |
| 7,318,709 | B2 * | 1/2008 | Koelzer et al. | 417/441 |
| 2005/0207905 | A1 * | 9/2005 | Koelzer et al. | 417/269 |

* cited by examiner

*Primary Examiner* — Thomas R. Hannon

(57) ABSTRACT

A swing barrel type positive displacement pump using a cross shaft joint bearing includes a main shaft (1) for connecting with a motor. The upper part of the main shaft (1) is slantwise provided with a rotating barrel (2) which swings along with the rotation of the main shaft (1). The periphery of the rotating barrel (2) is evenly provided with more than three pin shafts (3). Each pin shaft (3) is sleeved with a cross shaft joint bearing (4). Each cross shaft joint bearing (4) includes a bearing (41) sleeved on the pin shaft (3). The outer ring of each bearing (41) is fixedly connected with a swing sleeve (42). Fixed shafts (421, 421') with the same axis extend along the left and right sides of the swing sleeve (42), respectively. The fixed shafts (421,421') are sleeved with a left and right bearing (43, 43'), respectively. The outer rings of the left and right bearings are fixedly connected with left and right cross shaft swing sleeves (44, 44'), respectively. The top ends of the left and right cross shaft swing sleeves (44, 44') are fixedly connected with each other. The bottom ends of the left and right cross shaft swing sleeves (44, 44') are fixedly connected with a connecting bar (5) which is hinged with a piston in a displacement chamber. The positive displacement pump has low wear, low energy consumption, sensitive rotation, high rotation speed, and long service life.

7 Claims, 1 Drawing Sheet

SWING BARREL TYPE POSITIVE DISPLACEMENT PUMP USING CROSS SHAFT JOINT BEARING

BACKGROUND OF THE INVENTION

The present invention relates to a kind of pump, and more specifically relates to a swing barrel type positive displacement pump.

Swing barrel type positive displacement pump currently available in the market comprises a main shaft connected with a motor. An upper part of the main shaft is slantwise provided with a rotating barrel which swings along with the rotation of the main shaft. Periphery of the rotating barrel is evenly provided with more than three displacement chambers and these displacement chambers form a pump cylinder. Outside the rotating barrel there is evenly provided with ball bearings. Bottom parts of the ball bearings are connected with one end of a connecting bar. Another end of the connecting bar adopts a ball shape and movably connects with a piston disposed inside the displacement chambers. The positive displacement pump according to the prior art transforms the rotational movement of the main shaft to vertical movement of the piston inside the displacement chambers via the swinging of the rotating barrel. The positive displacement pump according to the prior art can satisfactorily meet the requirements for a high-lift submersible pump in deserts or plateau. However, since the ball bearings outside the rotating barrel adopt the structure of sliding bearings which produce sliding friction with high coefficient of friction during operation, the ball bearings cannot satisfactorily perform efficient transmission of motion. Also, wearing of the ball bearings will increase the frequency of maintenance of the pump and thus shorten the life of the pump.

BRIEF SUMMARY OF THE INVENTION

In view of the aforesaid disadvantages now present in the prior art, the present invention provides a swing barrel type positive displacement pump using cross shaft joint bearing. This kind of pump is resistant to wearing and it improves the efficiency of motion transmission. This kind of pump can keep up a good maintained condition for a long period of time.

The present invention is attained as follows:

A swing barrel type positive displacement pump using cross shaft joint bearing comprises a positive displacement pump housing and a main shaft connected with a motor; an upper part of the main shaft is slantwise provided with a rotating barrel which swings along with the rotation of the main shaft; periphery of the rotating barrel is evenly provided with more than three pin shafts; on each of the pin shafts, there is sleeved with a cross shaft joint bearing, whereas the cross shaft joint bearing includes a bearing sleeved on a corresponding pin shaft of the pin shafts, whereas outer ring of the bearing is fixedly connected with a swing sleeve; whereas fixed shafts having a same axis and forming a cross with the corresponding pin shaft extend respectively from left and right sides of the swing sleeve; whereas the fixed shafts are sleeved with a left bearing and a right bearing respectively; whereas outer rings of the left bearing and the right bearing are fixedly connected with a left cross shaft swing sleeve and a right cross shaft swing sleeve respectively; whereas top ends of the left cross shaft swing sleeve and the right cross shaft swing sleeve are fixedly connected with each other; whereas bottom ends of the left cross shaft swing sleeve and the right cross shaft swing sleeve are fixedly connected with a connecting bar which is hinged with a piston in a displacement chamber.

The present invention can be modified as follows: the upper part of the main shaft is also connected with a downwardly-slanted shaft; the downwardly-slanted shaft is connected with an upwardly-slanted shaft via a slanted screw; each of the downwardly-slanted shaft and the upwardly slanted shaft is provided with a bearing assembly constituted by at least one bearing; the rotating barrel is sleeved on outer sides of the bearing assembly of the downwardly-slanted shaft and the bearing assembly of the upwardly slanted shaft.

The present invention can be further modified as follows: the top ends of the left cross shaft swing sleeve and the right cross shaft swing sleeve are fixedly connected with each other via a connection plate; the positive displacement pump housing is provided with a limiting plate which corresponds to the swing sleeve. A driven end of the swing sleeve is provided with a rolling wheel which corresponds to the limiting plate; the rolling wheel is a conical rolling wheel or a waist drum type rolling wheel.

The present invention can be further modified as follows: each of the bearing, the left bearing and the right bearing is a single roll bearing structure or an assembly constituted by a plurality of roll bearings.

The present invention has the following advantages: in lieu of the original bearing structure now present in the prior art, the present invention uses the swing sleeve and also the left cross shaft swing sleeve and the right cross shaft swing sleeve which are disposed on one same axis on the left and right sides of the swing sleeve. Since roll bearing structure is adopted on the swing sleeve, the left cross shaft swing sleeve and the right cross shaft swing sleeve, the present invention is characterized in its minimal wearing, low energy consumption, swift rotation, high rotation speed and long service life as compared with the original ball bearing structure that produces sliding friction. As such, the present invention is in closer line with the requirements for high efficiency and prolonged maintained condition of a positive displacement pump as required by a low carbon economy.

BRIEF DESCRIPTION OF THE DRAWINGS

The present invention is further described below with reference to the following detailed description and the accompanying drawings.

DETAILED DESCRIPTION OF THE INVENTION

Figure 1:
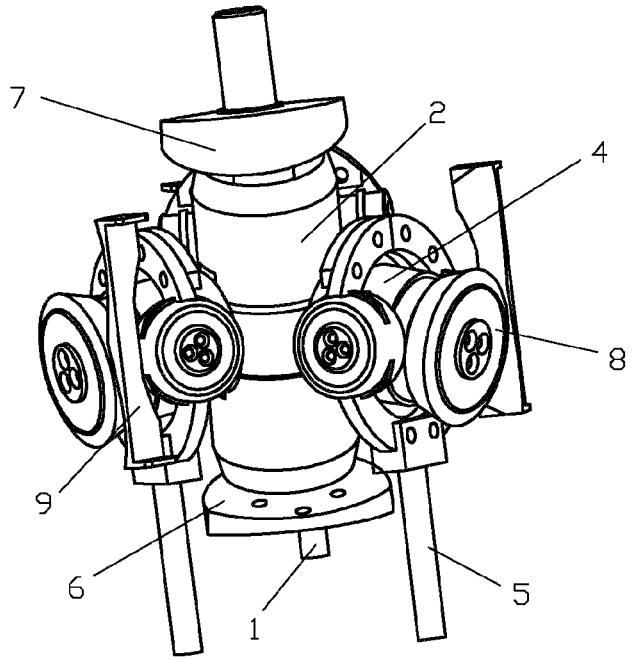
FIG. 1 is a structural view of the present invention.
Figure 2:
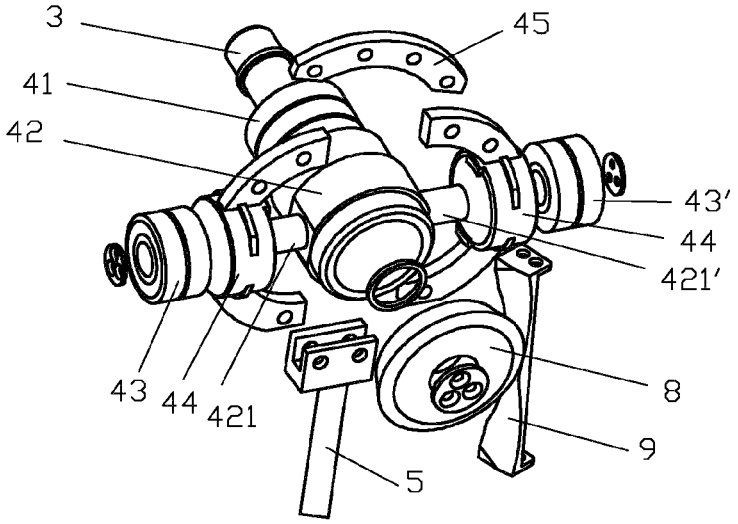
FIG. 2 is an exploded structural view of the cross shaft joint bearing according to the present invention.

As shown in FIGS. 1-2, a swing barrel type positive displacement pump using cross shaft joint bearing comprises a positive displacement pump housing and a main shaft 1 connected with a motor; an upper part of the main shaft 1 is slantwise provided with a rotating barrel 2 which swings along with the rotation of the main shaft 1; periphery of the rotating barrel 2 is evenly provided with more than three pin shafts 3; on each of the pin shafts 3, there is sleeved with a cross shaft joint bearing 4, whereas the cross shaft joint bearing 4 includes a bearing 41 sleeved on a corresponding pin shaft of the pin shafts 3, whereas outer ring of the bearing 41 is fixedly connected with a swing sleeve 42; whereas fixed shafts 421, 421' having a same axis and forming a cross with the corresponding pin shaft extend respectively from left and right sides of the swing sleeve 42; whereas extension from the top and bottom sides may also be an available option in actual practice; whereas the fixed shafts 421, 421' are sleeved with a left bearing 43 and a right bearing 43' respectively; whereas outer rings of the left bearing 43 and the right bearing 43' are fixedly connected with a left cross shaft swing sleeve 44 and a right cross shaft swing sleeve 44' respectively; whereas top ends of the left cross shaft swing sleeve 44 and the right cross shaft swing sleeve 44' are fixedly connected with each other via a connection plate 45 or they may be fixedly connected directly; whereas bottom ends of the left cross shaft swing sleeve 44 and the right cross shaft swing sleeve 44' are fixedly connected with a connecting bar 5 which is hinged with a piston in a displacement chamber.

In order that the rotating barrel 2 can swing along with the rotation of the main shaft 1, the upper part of the main shaft 1 is also connected with a downwardly-slanted shaft 6; the downwardly-slanted shaft 6 is connected with an upwardly-slanted shaft 7 via a slanted screw; each of the downwardly-slanted shaft 6 and the upwardly slanted shaft 7 is provided with a bearing assembly constituted by at least one bearing; the rotating barrel 2 is sleeved on outer sides of the bearing assembly of the downwardly-slanted shaft 6 and the bearing assembly of the upwardly slanted shaft 7. Also, the positive displacement pump housing is provided with a limiting plate 9 which corresponds to the swing sleeve 42. A driven end of the swing sleeve 42 is provided with a rolling wheel 8 which corresponds to the limiting plate 9. The rolling wheel 8 is blocked by the limiting plate 9 and therefore will not rotate along with the downwardly-slanted shaft 6 and the upwardly-slanted shaft 7, instead, it will only swing. Hence, fluid transmission can be accomplished via the driving force of the connecting bar 5 which drives the piston inside the displacement chamber to move up and down. Of course, the rolling wheel may be mounted in other alternative ways which are not limited by the foregoing description, for example, rolling wheel fixing shafts in a number that corresponds to the number of pin shafts 3 can be evenly disposed on the periphery of the rotating barrel 2, and the rolling wheel 8 that corresponds to the limiting plate 9 can be mounted on each of the rolling wheel fixing shafts.

To ensure smooth rotation of the rolling wheel 8, the rolling wheel can be a conical rolling wheel which can effectively ensure consistent angular velocity during rotation. Alternatively, the rolling wheel 8 may also be a waist drum type rolling wheel which can reduce contacting surface area with the limiting plate 9 and avoid difference of velocity of its inner side and the outer side during rotation.

To ensure swifter rotation of the swing sleeve 42 and the left cross shaft swing sleeve 44 and the right cross shaft swing sleeve 44', each of the bearing 41, the left bearing 43 and the right bearing 43' is a single roll bearing structure or an assembly constituted by a plurality of roll bearings.

In lieu of ball bearing structure, the present invention uses the swing sleeve 42 and also the left cross shaft swing sleeve 44 and the right cross shaft swing sleeve 44' which are disposed on one same axis on the left and right sides of the swing sleeve 42. Since roll bearing structure is adopted on the swing sleeve, the left cross shaft swing sleeve 44 and the right cross shaft swing sleeve 44', the present invention is characterized in its minimal wearing, low energy consumption, swift rotation, high rotation speed and long service life as compared with ball bearing structure that produces sliding friction. As such, the present invention is in closer line with the requirements for high efficiency and prolonged maintained condition of a positive displacement pump as required by a low carbon economy.

What is claimed is:

1. A swing barrel type positive displacement pump using cross shaft joint bearing comprises a positive displacement pump housing and a main shaft (1) connected with a motor; an upper part of the main shaft (1) is slantwise provided with a rotating barrel (2) which swings along with the rotation of the main shaft (1); periphery of the rotating barrel (2) is evenly provided with more than three pin shafts (3); wherein on each of the pin shafts (3), there is sleeved with a cross shaft joint bearing (4), whereas the cross shaft joint bearing (4) includes a bearing (41) sleeved on a corresponding pin shaft of the pin shafts (3), whereas outer ring of the bearing (41) is fixedly connected with a swing sleeve (42); whereas fixed shafts (421, 421') having a same axis and forming a cross with the corresponding pin shaft extend respectively from left and right sides of the swing sleeve (42); whereas the fixed shafts (421, 421') are sleeved with a left bearing (43) and a right bearing (43') respectively; whereas outer rings of the left bearing (43) and the right bearing (43') are fixedly connected with a left cross shaft swing sleeve (44) and a right cross shaft swing sleeve (44') respectively; whereas top ends of the left cross shaft swing sleeve (44) and the right cross shaft swing sleeve (44') are fixedly connected with each other; whereas bottom ends of the left cross shaft swing sleeve (44) and the right cross shaft swing sleeve (44') are fixedly connected with a connecting bar (5) which is hinged with a piston in a displacement chamber.

2. The swing barrel type positive displacement pump using cross shaft joint bearing as in claim 1, wherein the upper part of the main shaft (1) is also connected with a downwardly-slanted shaft (6); the downwardly-slanted shaft (6) is connected with an upwardly-slanted shaft (7) via a slanted screw; each of the downwardly-slanted shaft (6) and the upwardly slanted shaft (7) is provided with a bearing assembly constituted by at least one bearing; the rotating barrel (2) is sleeved on outer sides of the bearing assembly of the downwardly-slanted shaft (6) and the bearing assembly of the upwardly slanted shaft (7).

3. The swing barrel type positive displacement pump using cross shaft joint bearing as in claim 1, wherein the top ends of the left cross shaft swing sleeve (44) and the right cross shaft swing sleeve (44') are fixedly connected with each other via a connection plate (45).

4. The swing barrel type positive displacement pump using cross shaft joint bearing as in claim 1, wherein the positive displacement pump housing is provided with a limiting plate (9) which corresponds to the swing sleeve (42); a driven end of the swing sleeve (42) is provided with a rolling wheel (8) which corresponds to the limiting plate (8).

5. The swing barrel type positive displacement pump using cross shaft joint bearing as in claim 4, wherein the rolling wheel (8) is a conical rolling wheel.

6. The swing barrel type positive displacement pump using cross shaft joint bearing as in claim 4, wherein the rolling wheel (8) is a waist drum type rolling wheel.

7. The swing barrel type positive displacement pump using cross shaft joint bearing as in claim 1, wherein each of the bearing (41), the left bearing (43) and the right bearing (43') is a single roll bearing structure or an assembly constituted by a plurality of roll bearings.

* * * * *